US007017555B2

(12) United States Patent
Heinstein et al.

(10) Patent No.: US 7,017,555 B2
(45) Date of Patent: Mar. 28, 2006

(54) METHOD FOR OPERATING AN INTERNAL COMBUSTION ENGINE OF A MOTOR VEHICLE IN PARTICULAR

(75) Inventors: Axel Heinstein, Wimsheim (DE); Axel Storch, Moeglingen (DE); Guido Pilgram, Schwieberdingen (DE); Klaus Ries-Mueller, Bad Rappenau (DE); Detlef Nowak, Heilbronn (DE); Stefan Lauter, Asperg (DE); Robert Koehler, Bad Liebenzell/Monakam (DE); Jens Botte, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/820,313

(22) Filed: Apr. 7, 2004

(65) Prior Publication Data

US 2004/0260449 A1 Dec. 23, 2004

(30) Foreign Application Priority Data

Apr. 10, 2003 (DE) ..... 103 16 391

(51) Int. Cl.
*F02M 37/04* (2006.01)

(52) U.S. Cl. ..... 123/467; 123/447

(58) Field of Classification Search ..... 123/467, 123/419, 436, 447, 446, 198 D
See application file for complete search history.

(56) References Cited

U.S. PATENT DOCUMENTS

| | | | | | |
|---|---|---|---|---|---|
| 4,064,846 | A * | 12/1977 | Latsch et al. | ..... | 123/406.23 |
| 4,357,662 | A * | 11/1982 | Schira et al. | ..... | 701/111 |
| 5,408,970 | A * | 4/1995 | Burkhard et al. | ..... | 123/447 |
| 5,676,114 | A * | 10/1997 | Tarr et al. | ..... | 123/446 |
| 6,244,241 | B1 * | 6/2001 | Mamiya et al. | ..... | 123/295 |
| 6,705,543 | B1 * | 3/2004 | Carroll et al. | ..... | 239/96 |
| 6,708,481 | B1 * | 3/2004 | Kamen et al. | ..... | 60/39.6 |
| 6,746,495 | B1 * | 6/2004 | Avery et al. | ..... | 44/640 |
| 6,823,834 | B1 * | 11/2004 | Benson et al. | ..... | 123/299 |
| 2003/0047166 | A1 * | 3/2003 | Hess et al. | ..... | 123/436 |

* cited by examiner

*Primary Examiner*—Carl S. Miller
(74) *Attorney, Agent, or Firm*—Kenyon & Kenyon

(57) ABSTRACT

In a method for operating an internal combustion engine of a motor vehicle, in particular, pressurized fuel is conveyed to a fuel accumulator. The fuel is injected into a combustion chamber via a fuel injector. Coking of the fuel injector is determined. A first fuel-pressure increase is implemented when the coking exceeds a threshold value.

9 Claims, 2 Drawing Sheets

METHOD FOR OPERATING AN INTERNAL COMBUSTION ENGINE OF A MOTOR VEHICLE IN PARTICULAR

FIELD OF THE INVENTION

The present invention is based on a method for operating an internal combustion engine of a motor vehicle, in particular, in which the fuel is supplied under a pressure to a fuel reservoir and in which the fuel is injected into a combustion chamber via a fuel injector. The present invention also relates to a computer program, a control device and an internal combustion engine of a corresponding type.

BACKGROUND INFORMATION

A method is known from internal combustion engines having direct injection, for example.

It is known from such internal combustion engines that the fuel injectors may be fouled as a result of the combustion process. This means that deposits form on the fuel injectors, especially at the tip of the fuel injectors. These deposited particles may interfere with the flow of fuel through the fuel injector. The deposits may likewise change the characteristic of the nozzle jet generated by the fuel injector. This may all result in reduced combustion quality and thus in greater emission of pollutants.

It is an objective of the present invention to provide a method by which a cleaning of the fuel injectors may be carried out.

SUMMARY OF THE INVENTION

According to the present invention, this objective is achieved by a method of the type mentioned above in that coking of the fuel injector is ascertained and a first fuel-pressure increase is implemented when the coking exceeds a threshold value. In a computer program or a control device or an internal combustion engine of the type mentioned above, this object is achieved accordingly.

The fuel-pressure increase acts on possible deposits or the deposited particles in such a way that they are detached and thus removed. This constitutes a cleaning of the fuel injector. In addition to this removal of existing deposits, the fuel-pressure increase also ensures that new deposits are slower to form or do not form at all.

In an advantageous further development of the present invention, the first fuel-pressure increase is carried out for a predefinable period of time. This has the effect that the fuel-pressure increase is automatically terminated again.

It is particularly advantageous in this context if the fuel-pressure increase is repeated. This provides an additional possibility for cleaning the fuel injectors in those cases where the first implementation of the fuel-pressure increase has not achieved a complete cleaning. By repeating the fuel-pressure increase multiple times, an effective cleaning of the fuel injectors may thus be achieved.

In an advantageous development of the present invention, the repeat of the first fuel-pressure increase is terminated when the coking falls below a threshold value and/or when the number of repeats exceeds a threshold value. In both cases it is ensured that the fuel-pressure increase is carried out several times, but that it is also automatically ended again.

DETAILED DESCRIPTION

Figure 1:
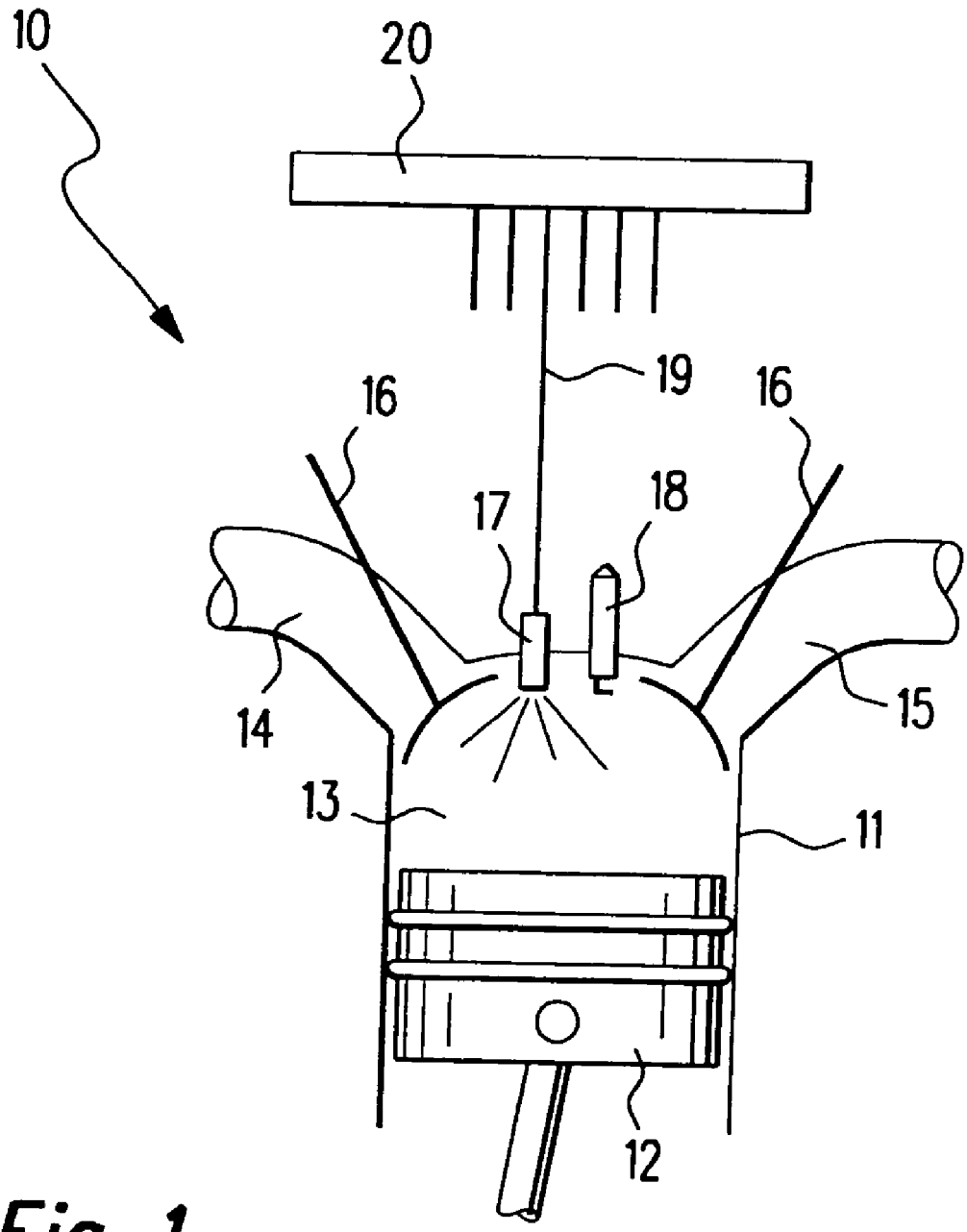
FIG. 1 shows a schematic representation of an exemplary embodiment of an internal combustion engine according to the present invention.

FIG. 1 shows an internal combustion engine 10, which is provided for use in a motor vehicle, in particular. Internal combustion engine 10 is a gasoline internal combustion engine having direct injection. However, the present invention described in the following may be used in a corresponding manner for a diesel combustion engine as well.

Internal combustion engine 10 has a cylinder 11 in which a piston 12 is able to be moved back and forth. Cylinder 11 and piston 12 delimit a combustion chamber 13. Connected to combustion chamber 13 is an intake manifold 14, via which air may be conveyed to combustion chamber 13. Furthermore, an exhaust pipe 15 via which the exhaust gas is able to be discharged from combustion chamber 13 is connected to combustion chamber 13. Valves 16 are provided to control the air supply and the exhaust flow. Furthermore, a fuel injector 17 and a spark plug 18 are assigned to combustion chamber 13. Fuel may be injected into combustion chamber 13 via fuel injector 17, and the injected fuel is able to be ignited, and thus combusted, in combustion chamber 13 with the aid of spark plug 18.

Fuel injector 17 is connected to a fuel accumulator 20 by means of a high-pressure line 19. Fuel accumulator 20 is continuously supplied with fuel under high pressure. A fuel-delivery pump and a high-pressure pump are normally provided for this purpose. The pressure in fuel accumulator 20 may be controlled and/or regulated to specified values. To this end, a pressure sensor and a pressure-control valve may be assigned to fuel accumulator 20. All cylinders 11 of internal combustion engine 10 are then supplied with fuel from pressure accumulator 20.

Figure 2:
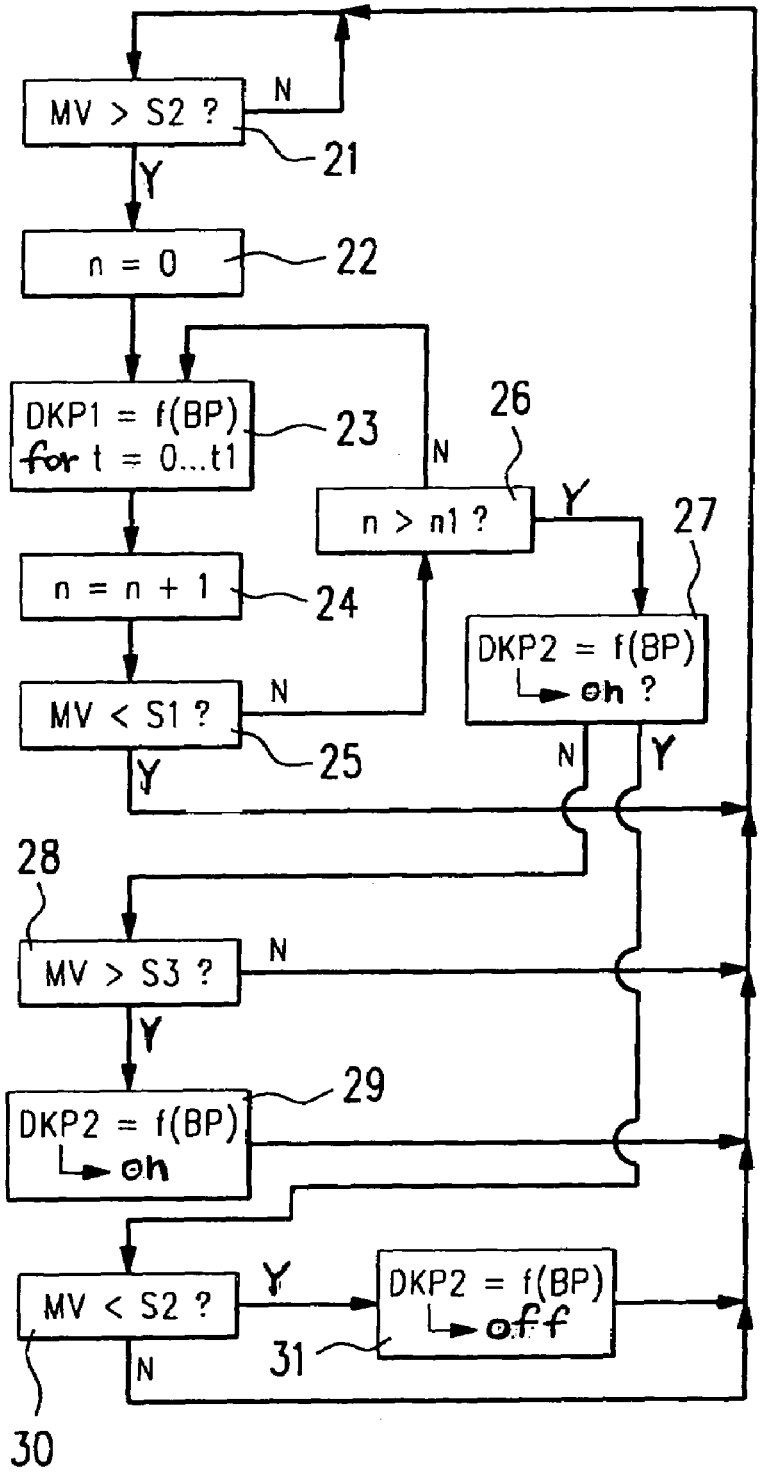
FIG. 2 shows a schematic flow chart of an exemplary embodiment of a method according to the present invention for operating the internal combustion engine of FIG. 1.

FIG. 2 shows a method for operating internal combustion engine 10. This method is carried out by a control device, which receives input signals from sensors, the pressure sensor, for example, and generates the output signals for actuators, such as fuel injector 17 or the pressure-control valve, via which internal combustion engine 10 may be controlled. The control device is designed such that it is able to execute the method described in the following. To this end, the control device may be configured as analog circuit technology and/or as a digital processor having a memory. In the latter case, a computer program is provided, which is programmed in such a way that the described method is implemented with the aid of the computer program.

The method assumes that a measure is available for the coking of fuel injector 17, this measure for the coking being called coking MV in the following. Furthermore, it is assumed that coking MV is present as percent information and in a value range of 0 to 100%.

The measure for the coking may be determined, for example, by a counter being provided, which counts and adds up coking-critical operating points of internal combustion engine 10, so as to generate and provide coking MV as a function thereof. As an alternative or in addition, it is possible to infer coking MV from a measured or determined lambda deviation. It is understood that coking MV may also be ascertained in some other manner, possibly also with the aid of sensors and/or models. It is likewise understood that coking MV may also have different value ranges.

The method of FIG. 2 provides three threshold values, S1, S2 and S3. First threshold value S1 is smaller than second threshold value S2, and second threshold value S2 is smaller than third threshold value S3. Threshold value S1 is 3%, for example, threshold value S2 is 6%, for instance, and threshold value S3 is 15%, for example.

According to FIG. 2, it is ascertained in a step 21 whether coking MV is greater than threshold value S2. If this is not the case, that is to say, coking is less than 6%, for instance, no further measures are taken.

However, if coking MV is greater than threshold value S2, a counter n is set to zero in a step 22. Subsequently, in a step 23, the pressure in fuel accumulator 20 is increased by a value DKP1. The afore-mentioned first fuel-pressure increase DKP1 is determined as a function of the instantaneous operating point BP of internal combustion engine 10. This fuel-pressure increase DKP1 is maintained for a predefinable time period t1. After time period t1 has elapsed, fuel-pressure increase DKP1 is terminated, so that the pressure in fuel accumulator 20 assumes its normal values again.

In a subsequent step 24, counter n is incremented. Counter n thus indicates the number of implemented or repeated fuel-pressure increases DKP1.

The described fuel-pressure increase DKP1 for time period t1 may have the result that coking of fuel injector 17 is partially or even completely removed. This follows from the fact that the increased pressure exerted on the fuel is mechanically acting on particles that have deposited on fuel injector 17. This mechanical action may detach the particles and thereby reduce the coking.

In a step 25, it is ascertained whether coking MV is smaller than threshold value S1, that is to say, smaller than 3%, for example. If this is the case, fuel-pressure increase DKP1 has achieved a reduction of coking MV. In this case the method is continued with step 21.

However, if coking MV is not smaller than threshold value S1, it is ascertained in a step 26 whether counter n is greater than a predefinable threshold value n1. If threshold value n1 has not been reached yet, the method continues with steps 23, 24 and 25. This means that a new fuel-pressure increase DKP1 is carried out for time period t1 and counter n is incremented. Furthermore, provided coking MV is not less than threshold value S1, the described loop continues to be run through again until counter n has reached threshold value n1. That is to say, a renewed fuel-pressure increase DKP1 is implemented for time period t1 until the point is reached where either coking MV is less than threshold value S1, namely less than 3%, for instance, or until counter n is greater than threshold value n1.

In the first case, as already mentioned, the method is continued with step 21. In the second case, that is, when coking MV has not become less than threshold value S1 and counter n has reached threshold value n1, the method is continued with a step 27. In this second case, even multiple repeats of fuel-pressure increase DKP1 have failed to achieve a reduction of coking MV to below threshold value S1.

In step 27 it is checked whether a second fuel-pressure increase DKP2 is activated. It should be stated in this context that fuel-pressure increase DKP2 may be smaller or greater than fuel-pressure increase DKP1, and that it is ascertained as a function of instantaneous operating point BP of internal combustion engine 10. In contrast to fuel-pressure increase DKP1 which, as mentioned, is always carried out for time period t1 only, fuel-pressure increase DKP2 is either activated or deactivated. If fuel-pressure increase DKP2 is thus activated, it continues to act until it is turned off again.

If it is determined in step 27 that fuel-pressure increase DKP2 is deactivated, it is ascertained in a step 28 whether coking MV is greater than threshold value S3. If this is not the case, the method continues with step 21 without fuel-pressure increase DKP2 being activated.

However, if coking MV is greater than threshold value S3, that is to say, greater than 15%, for instance, fuel-pressure increase DKP2 is activated in a step 29. Given activated fuel-pressure increase DKP2, the method is then continued with step 21.

Fuel-pressure increase DKP2 has the effect that particles that have deposited on fuel injector 17 are mechanically acted upon in a continuous manner. For as long as coking MV continues to be greater than threshold value S2 nevertheless, fuel-pressure increase DKP1 according to steps 21 through 26 is implemented in addition, so that the pressure acting on the fuel is increased further in this manner. This doubly increased pressure acts on coking MV of fuel injector 17 and leads to a reduction of coking MV.

If it is determined in step 27 that fuel-pressure increase DKP2 is activated, it is ascertained in a step 30 whether coking MV is less than threshold value S2. If this is not the case, the method continues with step 21 without fuel-pressure increase DKP2 being turned off. In this case the attempt to reduce coking MV therefore continues via the additive linking of first and second fuel-pressure increases DKP1, DKP2.

However, if coking MV is less than threshold value S2, that is to say, less than 6%, for instance, fuel-pressure increase DKP2 will be deactivated again in a step 31. In this case, there is reduced coking MVB, so that the method is able to be continued with step 21.

In addition, it is possible that, following the activation of fuel-pressure increase DKP2 in step 29, the described method is not directly continued with step 21, but that steps 30 and possibly 31 are run through beforehand.

What is claimed is:

1. A method for operating an internal combustion engine of a motor vehicle, the method comprising:

supplying fuel under a pressure to a fuel accumulator;

injecting the fuel into a combustion chamber of the engine via a fuel injector;

ascertaining a coking of the fuel injector;

implementing a first fuel-pressure increase if the coking exceeds a threshold value; and repeating the first fuel-pressure increase, wherein the first fuel-pressure increase is implemented for a predefined time period.

2. A method for operating an internal combustion engine of a motor vehicle, the method comprising:

supplying fuel under a pressure to a fuel accumulator;

injecting the fuel into a combustion chamber of the engine via a fuel injector;

ascertaining a coking of the fuel injector;

implementing a first fuel-pressure increase if the coking exceeds a threshold value;

repeating the first fuel-pressure increase; and ending the repeating of the first fuel-pressure increase when the coking falls below a threshold value.

3. A method for operating an internal combustion engine of a motor vehicle, the method comprising:

supplying fuel under a pressure to a fuel accumulator;

injecting the fuel into a combustion chamber of the engine via a fuel injector;

ascertaining a coking of the fuel injector;

implementing a first fuel-pressure increase if the coking exceeds a threshold value;

repeating the first fuel-pressure increase; and ending the repeating of the first fuel-pressure increase when a number of repeats exceeds a threshold value.

4. The method according to claim 3, further comprising activating a second fuel-pressure increase when the coking exceeds a further threshold value.

5. The method according to claim 4, further comprising deactivating the second fuel-pressure increase when the coking falls below the threshold value.

6. The method according to claim 4, wherein the second fuel-pressure increase is activated only if the repeating of the first fuel-pressure increase is ended in that the number of repeats exceeds the threshold value.

7. A computer-readable medium containing a computer program which, when executed by a processor of a motor vehicle having an internal combustion engine, performs the following method;

supplying fuel under a pressure to a fuel accumulator;

injecting the fuel into a combustion chamber of the engine via a fuel injector;

ascertaining a coking of the fuel injector;

implementing a first fuel-pressure increase if the coking exceeds a threshold value; and repeating the first fuel-pressure increase, wherein the first fuel-pressure increase is implemented for a predefined time period.

8. A control device of a motor vehicle having an internal combustion engine for performing the following:

supplying fuel under a pressure to a fuel accumulator;

injecting the fuel into a combustion chamber of the engine via a fuel injector;

ascertaining a coking of the fuel injector;

implementing a first fuel-pressure increase if the coking exceeds a threshold value; and repeating the first fuel-pressure increase, wherein the first fuel-pressure increase is implemented for a predefined time period.

9. An internal combustion engine of a motor vehicle comprising a control device for performing the following:

supplying fuel under a pressure to a fuel accumulator;

injecting the fuel into a combustion chamber of the engine via a fuel injector;

ascertaining a coking of the fuel injector;

implementing a first fuel-pressure increase if the coking exceeds a threshold value; and repeating the first fuel-pressure increase, wherein the first fuel-pressure increase is implemented for a predefined time period.

* * * * *